US006418828B1

(12) United States Patent
Kalnitz

(10) Patent No.: US 6,418,828 B1
(45) Date of Patent: Jul. 16, 2002

(54) FORCE-ADJUSTABLE ROTARY APPARATUS FOR WORKING WEBS OR SHEETS OF MATERIAL

(75) Inventor: Howard J. Kalnitz, Howards Grove, WI (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/339,136

(22) Filed: Jun. 24, 1999

(51) Int. Cl.[7] ..... B26D 1/62

(52) U.S. Cl. ..... 83/346; 82/698.61; 82/699.61; 82/304

(58) Field of Search ..... 83/698.51, 698.61, 83/304, 305, 677, 663, 698.41, 699.51, 699.61, 508.2, 346

(56) References Cited

U.S. PATENT DOCUMENTS

| | | | | | |
|---|---|---|---|---|---|
| 3,008,366 | A | | 11/1961 | Taylor | 83/346 |
| 3,251,256 | A | * | 5/1966 | McGrath | 83/698.51 |
| 3,693,682 | A | | 9/1972 | Hasfjord | |
| 3,732,611 | A | | 5/1973 | Watanabe | |
| 3,813,982 | A | | 6/1974 | Waibel | |
| 4,009,626 | A | | 3/1977 | Gressman | |
| 4,592,399 | A | | 6/1986 | Rhodes | |
| 4,759,247 | A | | 7/1988 | Bell et al. | |
| 4,785,697 | A | * | 11/1988 | Gherardi | 83/346 |
| 4,819,525 | A | | 4/1989 | Rabe | |
| 4,962,683 | A | | 10/1990 | Scheffer et al. | |
| 5,367,936 | A | * | 11/1994 | Held et al. | 83/698.61 |
| 5,394,779 | A | * | 3/1995 | Meecks | 83/698.51 |
| 5,465,641 | A | * | 11/1995 | Herd | 83/698.61 |
| 5,467,678 | A | | 11/1995 | Stollenwork | |
| 5,475,889 | A | * | 12/1995 | Kimura | 83/228 |
| 5,771,770 | A | * | 6/1998 | Muller | 83/698.61 |
| 5,904,086 | A | * | 5/1999 | Figge et al. | 83/698.61 |
| 5,950,516 | A | * | 9/1999 | Stab | 83/698.51 |
| 6,158,316 | A | * | 12/2000 | Ichikawa et al. | 83/74 |

FOREIGN PATENT DOCUMENTS

| | | |
|---|---|---|
| WO | WO 97/30828 | 8/1997 |

* cited by examiner

*Primary Examiner*—Kenneth E. Peterson
*Assistant Examiner*—Omar Flores-Sáchez
(74) *Attorney, Agent, or Firm*—Michael S. Kolodesh; Ken K. Patel

(57) ABSTRACT

Disclosed is a rotary apparatus suitable for processing and working a web or sheet of materials such as plastic films, non-woven substrates, metal foils, paper, diaper cores and the like. Such apparatus includes counter-rotating anvil and tool rolls through which the web or sheet of material to be worked is fed. The tool roll includes at least one processing tool for working the web or sheet of material. The force of the tool on the web or sheet being worked is regulated by a force applied to the processing tool or the anvil surface of the anvil roll by a force-transmitting chamber which includes a fluid. The force applied is adjusted by altering the pressure of the fluid within the force-transmitting chamber.

19 Claims, 5 Drawing Sheets

FORCE-ADJUSTABLE ROTARY APPARATUS FOR WORKING WEBS OR SHEETS OF MATERIAL

FIELD OF THE INVENTION

This invention relates to an apparatus for processing and working continuous webs or discrete sheets of materials, including, for example, plastic films, non-woven substrates, metal foils, paper, absorbent pads, and the like. More particularly, the invention relates to a force-adjustable rotary apparatus for cutting, embossing, bonding, printing, etc., such webs or sheets of materials.

BACKGROUND OF THE INVENTION

Rotary web or sheet converting devices and setups are known, especially, for use in high speed applications for cutting, embossing, bonding and other process operations for working continuous webs or discrete sheets of materials. Such devices and setups usually involve the use of oppositely rotating rolls, one of which may carry one or more processing tools, and another roll which may serve as an anvil against which the material is worked by the processing tool. As the rolls rotate, when the tool and the anvil meet to work the web or sheet of material, the force applied between the tool and the anvil is an important factor affecting quality and efficiency of the operation. This is because the force affects the wear of the tool and, therefore, the frequency of downtime of apparatus for changing or repositioning the tool. The amount of force that the tool exerts on the web or sheet depends upon the engagement of the tool against the anvil surface. Very small differences in the engagement may result in substantial changes in the amount of the force, and this, in turn, may affect the longevity of the tool. The accuracy of the engagement may become even more important for relatively large tools when even a very small misalignment of the tool in relation to the anvil may subject a part of the tool to excessive forces, which in turn may result in accelerated wear of that part of the tool. Thus, because the amount of force between the tool and the anvil in a conventional rotary apparatus depends upon engagement of the tool against the anvil, a conventional rotary apparatus requires precise positioning of the tool in relation to the anvil.

Further, due to the required accuracy of the positioning of the tool, a conventional rotary apparatus generally involves substantial setup time to manually position the tool relative to the anvil. The manual setup may require a complete shutdown of the machine which, in turn, results in significant downtime and inefficiency.

Still further, during working of the material, as the tool gradually wears and deteriorates, the quality of the working may also deteriorate. Usually, the quality can be recaptured by increasing the force between the tool and the anvil. For conventional rotary apparatus, this means changing the engagement of the tool in relation to the anvil by repositioning the tool radially toward the anvil. Because a conventional rotary apparatus does not have the capability of changing the force during rotation, the change in force may require that the machine be shutdown, thus resulting in significant downtime. Therefore, in order to extend the time between shutdowns, the tool is usually adjusted to provide a larger than immediately needed increment of engagement. However, the drawback of this procedure is the generally reduced overall tool longevity due to more accelerated wear of the tool as the larger increments of engagement result in higher forces between the tool and the anvil.

Yet another drawback of a conventional rotary apparatus is that the apparatus generally requires different engagement between the tool and the anvil at lower rotational speeds than at higher rotational speeds, i.e., less clearance or more compression or interference between the tool and the anvil at lower rotational speeds than at higher rotational speeds. Because conventional rotary apparatus does not have the capability of changing the engagement of the tool during rotation of the tool, the tools are usually set for engagements suitable for lower rotational speeds to ensure satisfactory working of the material during machine startup. Working at higher rotational speeds (i.e., at production speeds after machine startup) with engagements suitable for lower rotational speeds may result in excessive forces between the tool and the anvil during higher rotational speeds. The effect may be accelerated wear of the tool at production speeds.

Thus, a conventional rotary apparatus exhibits a number of drawbacks which lead to operational deficiencies due to the initial setup time required, the frequency and duration of downtime necessary to maintain the proper operation, and the reduced longevity of the tool.

Accordingly, it may be desirable to provide a rotary apparatus which overcomes certain of the drawbacks exhibited by conventional rotary apparatus. Specifically, it may be desirable to provide a rotary apparatus which permits precise adjustment of the force between the tool and the anvil with minimal or no downtime. Further, it may be desirable to provide a rotary apparatus which employs a fluid pressure means for ready and quick adjustment of the force between the tool and the anvil with minimal or no downtime. Even further, it may be desirable to provide a rotary apparatus which enables one to reduce the time needed for changing the tool.

SUMMARY OF THE INVENTION

In order to overcome the drawbacks of current rotary apparatuses, the present invention provides a rotary apparatus suitable for processing and working a web or sheet of material such as plastic films, non-woven substrates, metal foils, paper, diaper cores and the like. Such an apparatus preferably includes a) a frame; b) an anvil roll (or similar component carrying an anvil surface) which is rotatably mounted on the frame; c) a tool roll (or similar component capable of carrying a tool) which is also rotatably mounted on the frame opposite the anvil roll; and d) drive means for rotating the anvil roll and the tool roll in opposite directions in a manner suitable for feeding the web or sheet of material being worked between the anvil roll and the tool roll. The tool roll has at least one processing tool associated with it. Such a tool is suitable for working the web or sheet of material which is positioned between the anvil roll and the tool roll. The apparatus also includes at least one chamber which includes a fluid and which is in force-transmitting communication with either the processing tool or with the anvil surface of the anvil roll or both such that a change in the fluid pressure (hydraulic or pneumatic) within the chamber serves to alter the force that is applied by the processing tool to the web or sheet of material being worked. Preferably the apparatus also includes means for changing and adjusting the pressure of the fluid within the chamber.

BRIEF DESCRIPTION OF THE DRAWINGS

While the specification concludes with claims particularly pointing out and distinctly claiming the subject matter which is regarded as the present invention, it is believed that the invention will be better understood from the following figures taken in conjunction with accompanying description in which like parts are given the same reference numeral.

DETAILED DESCRIPTION OF THE INVENTION

Figure 1:
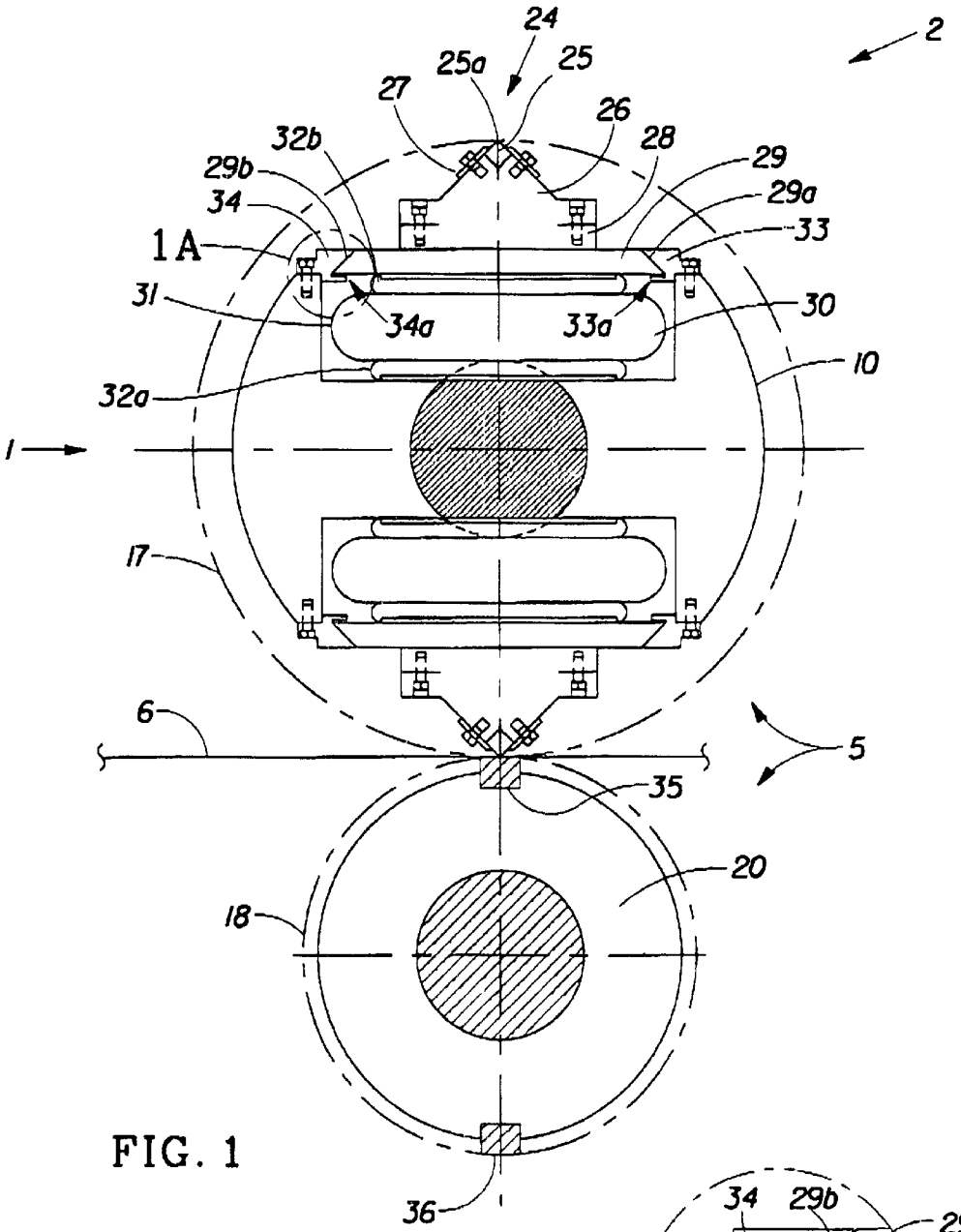
FIG. 1 is a simplified cross sectional view of a rotary apparatus embodying the essential features of this invention.
Figure 1A:
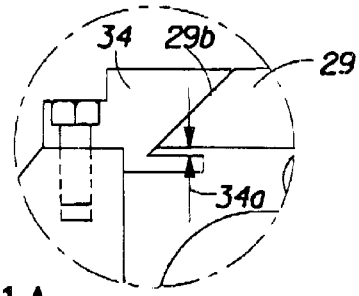
FIG. 1A is a magnified view of one of the radial clearances shown in FIG. 1.

This invention relates to an apparatus for cutting, embossing, bonding, and the like, webs or sheets of materials. The apparatus of the present invention may be useful for the processing of any material which has sufficient structural integrity to be processed as a continuous web or a discreet sheet, such as plastic films, non-woven substrates, metal foils, foams, rubbers, and other materials, either separately or in a combination, in a single or multiple-layer forms. However, for the purpose of simplicity the invention will be described in terms of preferred and alternative embodiments as shown in the drawings.

Figure 2:
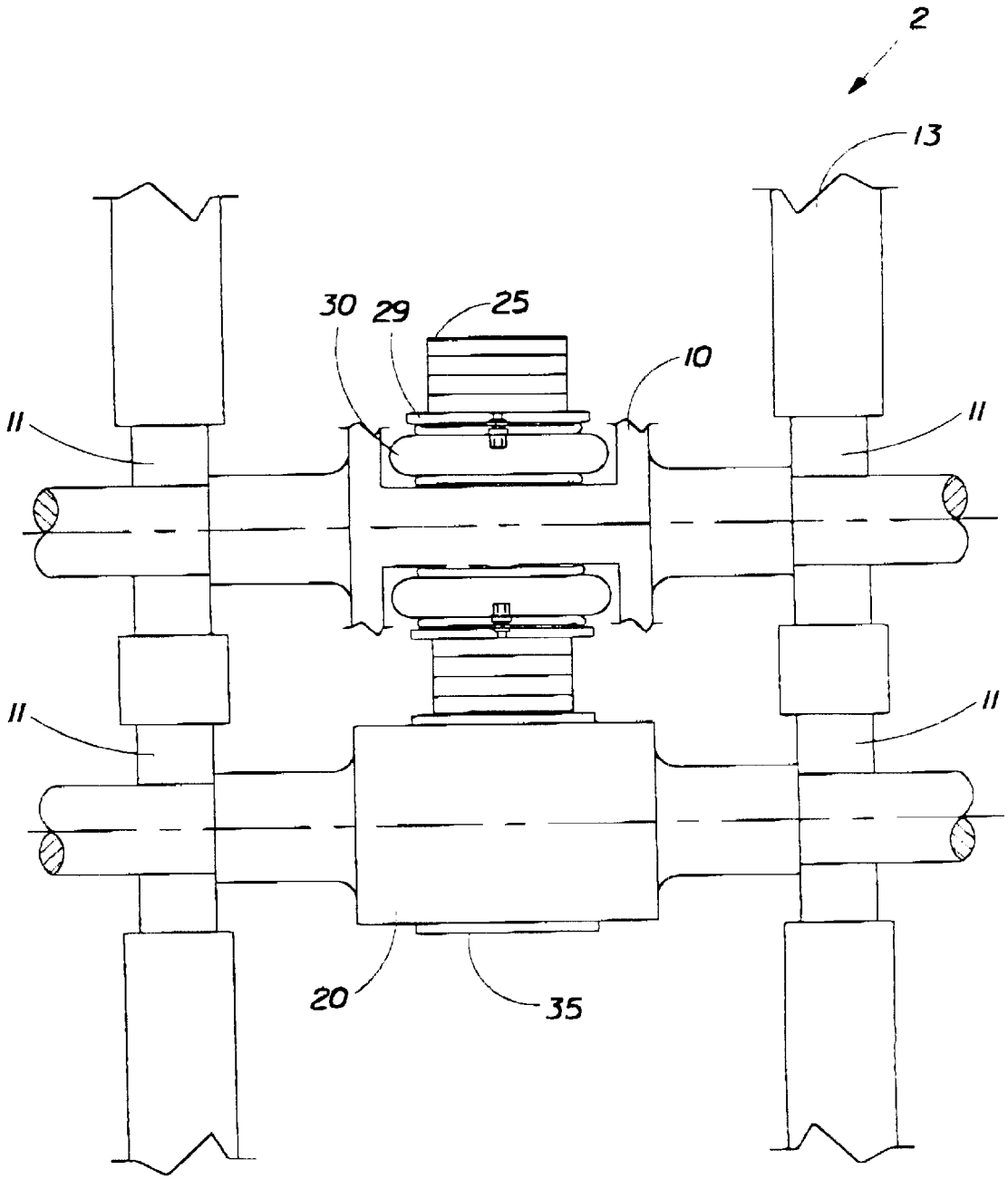
FIG. 2 is a simplified front view of the rotary apparatus.

Referring now to the drawings, FIGS. 1 and 2 illustrate one preferred embodiment of the present invention, wherein a rotary cutter 2 is used to cut a web of material 6. The rotary cutter 2 comprises a pair of generally parallel, counter-rotating rolls 5, both of which are mounted on a frame 13. The counter-rotating rolls 5 may be positioned vertically, horizontally, inclined, or in any other position. One of the rolls includes a tool roll 10 and the other roll includes an anvil roll 20. Drive means cause the tool roll 10 or anvil roll 20 to rotate in opposite directions from each other. In FIG. 1, for example, if the tool roll 10 rotates in a counterclockwise direction, then the anvil roll 20 rotates in a clockwise direction. The tool roll 10 also includes a knife assembly 24 operatively associated with an airbag 30.

The tool roll 10 may include one or more knife assemblies 24. Further, the tool roll 10 may be a circular roll or any other shaped roll, or any other mechanism or device which can be adapted to hold the knife assembly 24 or other tool in a position to work the web of material 6, being fed between the tool roll 10 and anvil roll 20. In a preferred embodiment, as shown in FIGS. 1 and 2, the knife assembly 24 works the web of material 6 against the anvil roll 20. Either the tool roll 10, the anvil roll 20 or both may be rotatably supported within the frame 13 by any means including, for example, bearings 11. The frame 13 may be any conventional frame or any other means for holding the tool roll 10 and anvil roll 20 in a desired position. The anvil roll 20 may include one or more anvils 35 located around the periphery of the anvil roll 20 which generally correspond with the knife 25 during rotation so as to provide a desired anvil surface 36 against which the knife 25 can cut the web of material 6. The anvil roll 20 may be a circular roll or any other shaped roll, or any other mechanism or device which may be adapted to hold the anvil 35 in position to interact with the knife 25. Alternatively, the anvil roll itself may provide the desired anvil surface 36 against which the knife 25 can cut the web of material 6, such that no anvil is necessary.

Also as shown in FIG. 1, the knife assembly 24 may include a knife 25; a knife-chuck 26 for nesting the knife 25 in a preferred position; and plates 27 for securing the knife 25 in position. However, the knife 25 could be held by any other means which may be adapted so as to hold the knife 25 in a position to cut the web of material 6. In one preferred embodiment, the knife 25 may comprise a square-shaped tool having four cutting edges 25*a*. However, the knife 25 may have any number of cutting edges, and the knife 25 may be of any form and size so as to provide sufficient cutting means for the web of material 6 and the like. For example, the knife 25 can be a rectangular blade having one or two cutting edges, or have a triangle or hexagonal shape, etc. Also, the knife 25 may be made from any suitable material, such as a tool steel, ceramics, composite materials, etc. In a preferred embodiment, as shown in FIG. 1, the knife assembly 24 may be joined to the airbag 30 through a spacer 28 and a mounting plate 29. In a preferred embodiment, the mounting plate 29 may include dove-tail sides 29*a* and 29*b* for engaging with the dove-tail holders 33 and 34. The dove-tail holders 33 and 34 are attached to the tool roll 10 and provide radial clearance 33*a* and 34*a* for the dove-tail sides 29*a* and 29*b*, preferably of about 0.002" and 0.005", respectively. The mounting plate 29 provides not only a desired relative position of the knife assembly 24 and the airbag 30 in relation to the tool roll 10, but also ensures that the cutting force which occurs between the knife 25 and the anvil 35 is transmitted from the airbag 30. (As used herein, the term "cutting force" refers to the force which occurs between the knife and the anvil when material is cut.) It should be noted that any other mounting arrangement of the knife 25 and the airbag 30 may be suitable to provide a desired position of the knife 25 in relation to the tool roll 10 and a transmission of the cutting force from the knife 25 to the airbag 30. The spacer 28 serves to provide a desired engagement or interference between the knife 25 and the anvil 35. The spacer 28 may be machined to a desired thickness, preferably after assembling the knife assembly 24. (As used herein, the term "interference" refers to the interference or radial compression between the knife 25 and its corresponding anvil 35 due to the overlapping rotational trajectories 17 and 18 of the knife 25 and the anvil 35, respectively.) However, other mounting arrangements for achieving a desired relative position between the knife 25 and the anvil 35 may be suitable, for example, use of a shim stock, etc.

In a preferred embodiment, the airbag 30 includes an expandable vessel 31 which is enclosed from the sides by a front plate 32*a* and a back plate 32*b*. The plates 32*a* and 32*b* can move generally parallel to each other upon the inflation or deflation of the vessel 31. The airbag 30 may be of any size, shape, or form so as to provide the desired force between the knife 25 and the anvil 35. One suitable airbag 30 is an Airstroke Actuator, Model No. W01-358-7731, available from Firestone Corp.

The airbag 30 may serve to adjust the cutting force between the cutting knife 25 and the anvil 35 by changing the air pressure in the air bag 30. Accordingly, the present invention may also include means for changing or regulating the pressure within the air bag 30. In contrast to the prior-art rotary cutters, in which the cutting force can only be adjusted by changing the interference between the knife and anvil, the rotary cutter of the present invention allows adjustment of the cutting force without changing the interference between the cutter and the anvil. The interference can be set once, for example, via the spacer 28, to ensure a complete contact between the knife and the anvil, and the cutting force can be then changed without readjusting the knife 25 and without stopping the rotary cutter 2. The cutting force can be changed by increasing or decreasing the air pressure in the air bag 30. Similarly, after the rotary cutter 2 starts up and accelerates to a target production speed, the air pressure in the airbag 30 can be adjusted to any desired level. Also, the air pressure can be increased, without stopping the rotary cutter 2, when the knife edge 25*a* becomes dull and a higher cutting force is needed to maintain the desired quality of the cut. The increase of the air pressure may be minimal, but sufficient enough to maintain the quality of the cut. After the knife edge 25*a* deteriorates further, the air pressure in the airbag 30 can be increased further, and again, incrementally enough to maintain the desired quality of the cut.

In a preferred embodiment, a drive means for rotating the cutter 2 is operatively associated with the tool roll 10 and the anvil roll 20 to affect predetermined synchronized counter-rotation of the rolls. It should be noted that the drive means may be operatively associated with either one of the rolls, or both. Also, the tool roll 10 and/or anvil roll 20 may be driven by the web of material 6 if the web of material 6 has sufficient integrity for rotating the rolls 10 and/or 20.

It should be also noted that the number of the tool rolls 10 or the number of the anvil rolls 20 operatively associated with each other does not affect the present invention. Any number of tool rolls and any number of anvil rolls operatively associated in various combinations, can be used.

Figure 3:
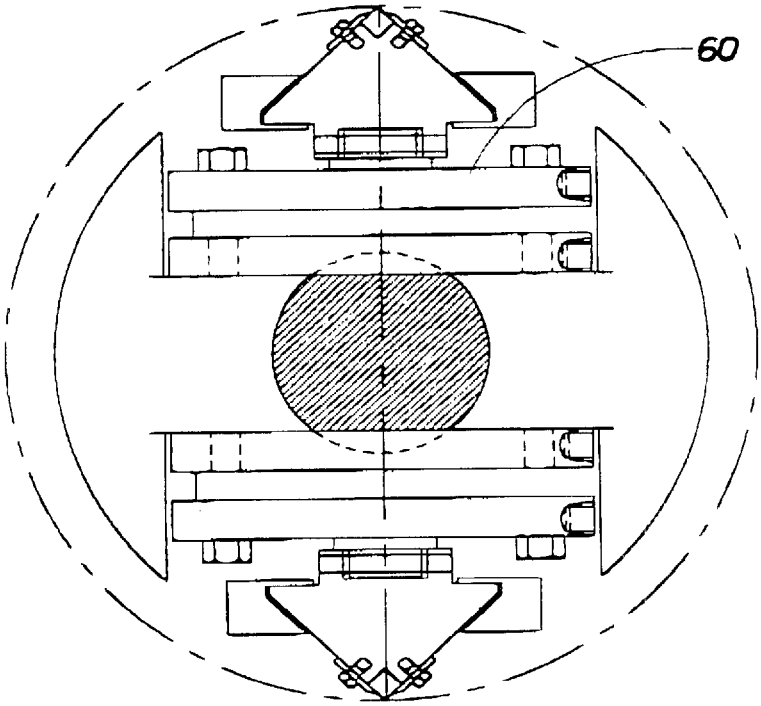
FIG. 3 is a simplified cross sectional view of a tool roll embodying an air cylinder.

It should be also noted that as an alternative to the air bag 30, any other fluid-pressure chamber containing a fluid and which is capable of changing a pressure of the contained fluid and transmitting that change in pressure into a force extending outside the device can be used as the chamber in the present invention. The chamber may comprise, for instance, pneumatic or hydraulic devices utilizing any fluid, for example, gases, oils, and other fluids, or combinations thereof As an example of an alternative embodiment, FIG. 3 illustrates the use of an air cylinder 60 positioned in the tool roll 10 in place of the airbag 30.

Means for changing the pressure of the fluid in the chamber can include any known device or conventional arrangement wherein the amount of fluid in the chamber can be changed or temperature and pressure conditions within the chamber can be changed. One suitable pressure regulating device can be, for example, a hand regulator valve Model R08-200-RGMA, available from Norgren Co.

Figure 4:
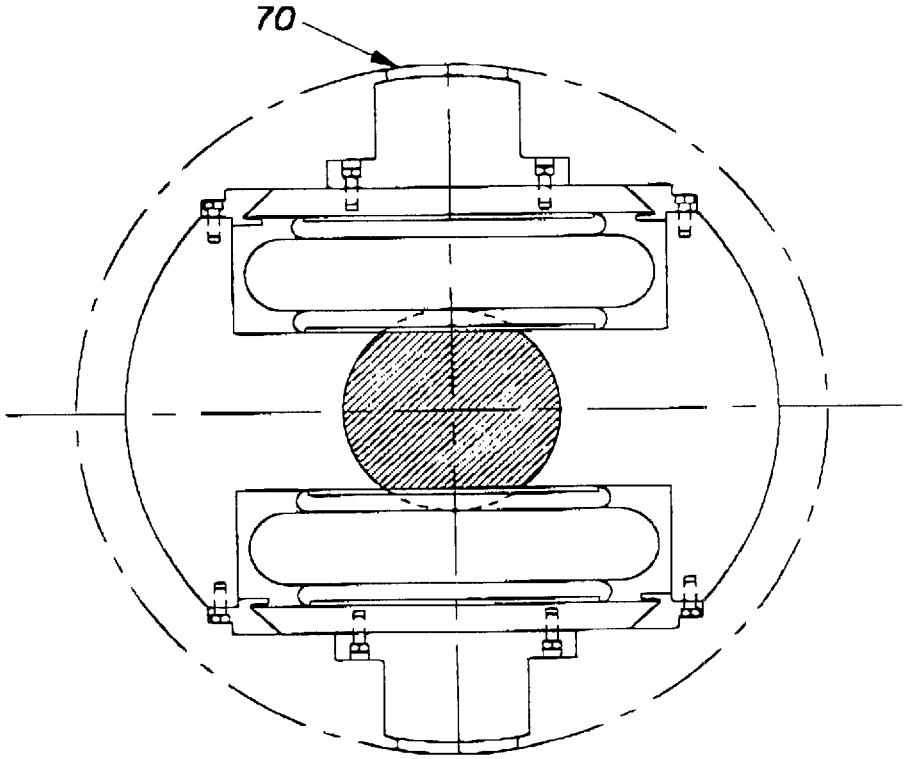
FIG. 4 is a simplified cross sectional view of a tool roll embodying a die cutter.
Figure 5:
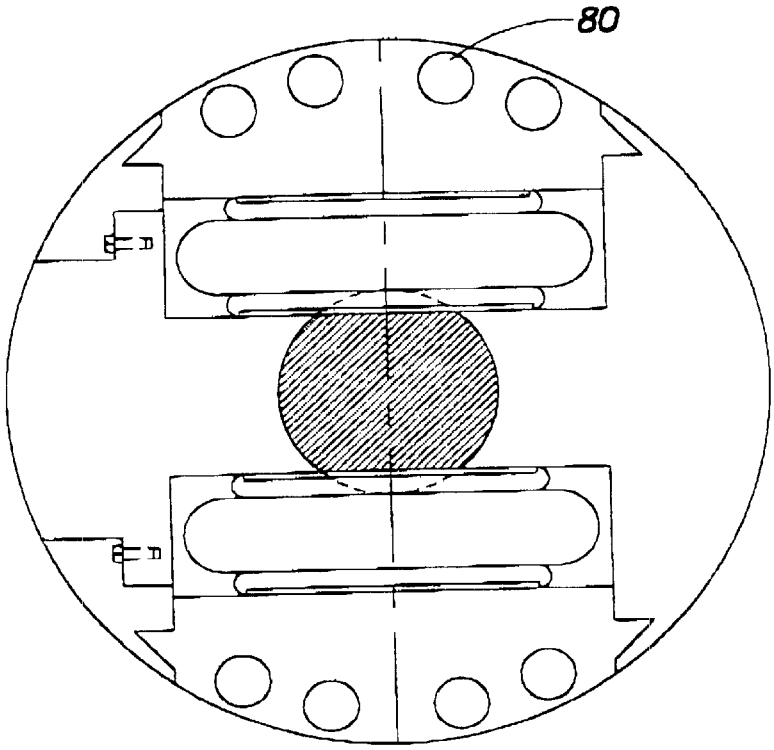
FIG. 5 is a simplified cross sectional view of a tool roll employing an embossing tool.

It should be further noted that as an alternative to the knife 25, any other processing tool affecting the web of material 6 can be used in the present invention, For example, the tool roll 10 may employ a die cutter 70, as shown in FIG. 4, for performing area cuts from the web of material 6. Further, the tool roll 10 may employ an embossing tool 80, as shown in FIG. 5, for embossing the web of material 6. Still further, the tool roll 10 may employ a printing tool or a bonding tool, such as, for example, a heat bonding, ultra-sound bonding, etc. Even further, the tool roll 10 may employ any combination of the tool alternatives described above.

Figure 6:
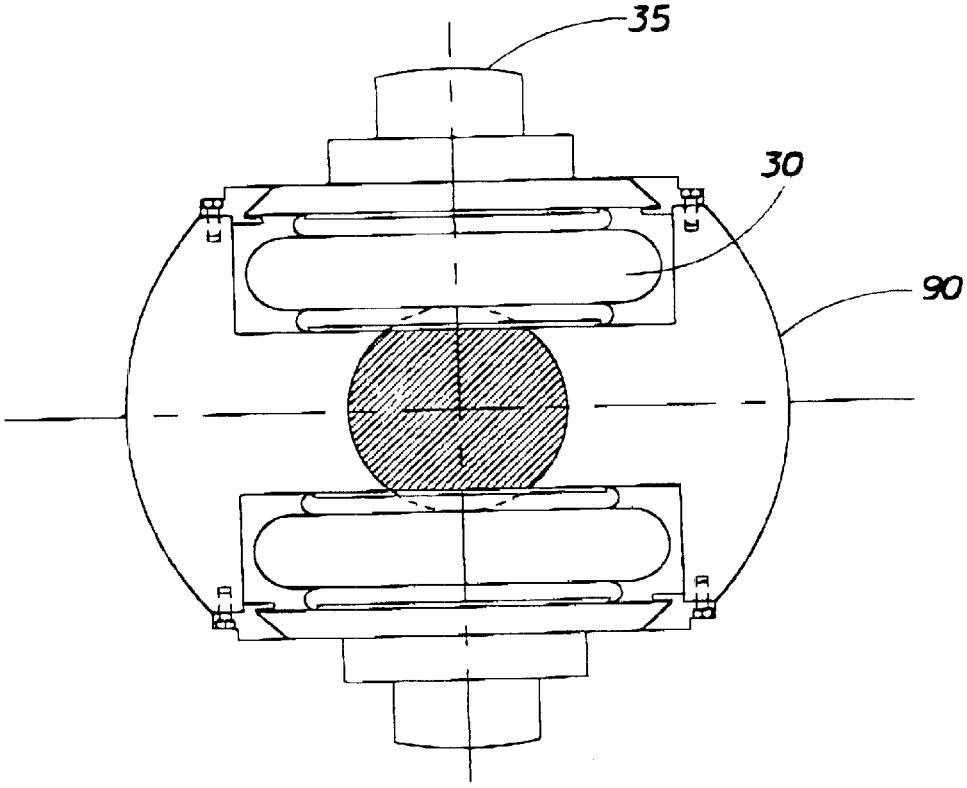
FIG. 6 is a simplified cross sectional view of an anvil roll employing an airbag.

As an alternative to locating the air bag 30 in the tool roll 10, the air bag 30 or any other fluid-pressure device as described above for use as the chamber may be located in the anvil roll 20 and associated with an anvil 35 to affect the force between the anvil 35 and the knife 25 or any other alternative tool as described above. FIG. 6 shows the air bag 30 which is located in an anvil roll 90 and is attached to the anvil 35.

Figure 7:
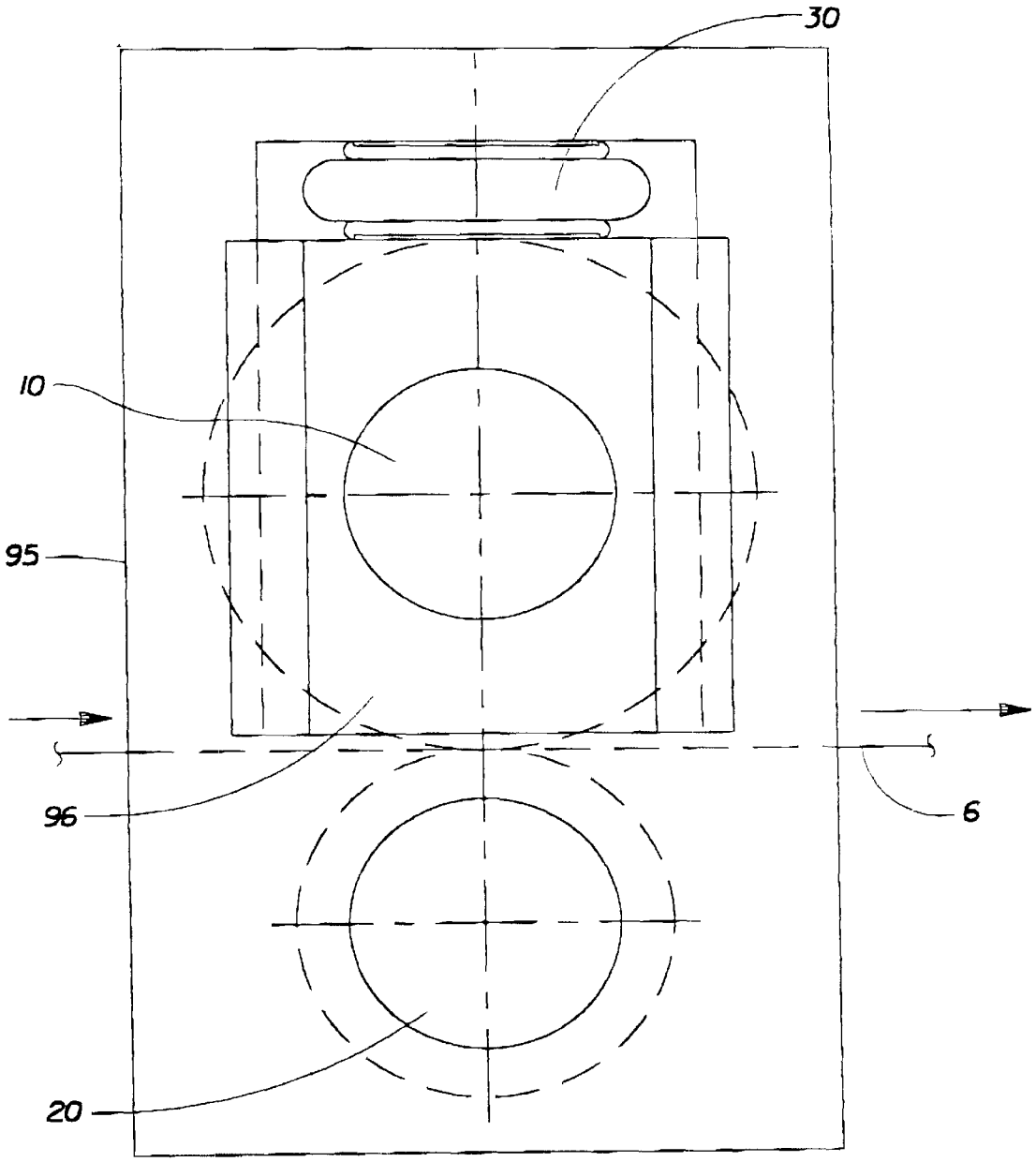
FIG. 7 is a simplified side view of a rotary apparatus employing an airbag outside a tool roll.

In an alternative embodiment, the air bag 30 or any other fluid-pressure device as described above for use as the chamber may be located outside the tool roll 10 and/or the anvil roll 20. For example, FIG. 7 illustrates the airbag 30 located outside the anvil roll 10. In this case, the anvil roll 10 is slidably positioned in a frame 95 via a slide 96 or any other means that would allow radial movement of the tool roll 10 in relation to the anvil roll 20. This enables one to adjust the force between the tool roll 10 and the anvil roll 20 for working the web of material 6 by adjusting the air pressure of the airbag 30 without stopping the machine.

While particular embodiments and or individual features of the present invention have been illustrated and described, it would be obvious to those skilled in the art that various other changes and modifications can be made without departing from the spirit and scope of the invention. Further, it should be apparent that all combinations of such embodiments and features are possible and can result in preferred executions of the invention. Therefore, the appended claims are intended to cover all such changes and modifications that are within the scope of this invention.

What is claimed is:

1. A rotary apparatus suitable for processing or working a web or sheet of material, the apparatus comprising:

a) an anvil roll having an anvil surface;

b) a tool roll disposed opposite said anvil roll;

c) drive means for rotating said anvil roll and said tool roll in opposite directions in a manner suitable for feeding said web or sheet of material between said anvil roll and said tool roll;

d) at least one processing tool associated with said tool roll and suitable for applying a force to said web or sheet of material positioned between said anvil roll and said tool roll so as to work said web; and e) at least one chamber including a fluid, said chamber having a fluid pressure and being in force-transmitting communication with said processing tool or with said anvil surface on said anvil roll such that a change in said fluid pressure within said chamber serves to alter said force applied by said processing tool to said web or sheet of material, wherein said force-transmitting communication is provided by a mounting plate having a first dove-tail side and a second dove-tail side for engaging with a first dove-tail holder and a second dove-tail holder, respectively, to provide a first radial clearance between said first dove-tail side and said first dove-tail holder and a second radial clearance between said second dove-tail side and said second dove-tail holder, and wherein said first radial clearance is different from said second radial clearance.

2. The rotary apparatus according to claim 1 which additionally comprises a frame, wherein said anvil roll and/or said tool roll are rotatably mounted on said frame.

3. A rotary apparatus suitable for processing or working a web or sheet of material, the apparatus comprising:

a) a frame;

b) an anvil roll having an anvil surface, said anvil roll being rotatably mounted on said frame;

c) a tool roll rotatably mounted on said frame opposite said anvil roll;

d) drive means for rotating said anvil roll and said tool roll in opposite directions in a manner suitable for feeding said web or sheet of material between said anvil roll and said tool roll;

e) at least one processing tool associated with said tool roll and suitable for applying a force to said web or sheet of material positioned between said anvil roll and said tool roll so as to work said web; and f) at least one chamber including a fluid, said chamber having a fluid pressure and being in force-transmitting communication with said processing tool or with said anvil surface on said anvil roll such that a change in said fluid pressure within said chamber serves to alter said force applied by said processing tool to said web or sheet of material, wherein said force-transmitting communication is provided by a mounting plate having a first dove-tail side and a second dove-tail side for engaging with a first dove-tail holder and a second dove-tail holder, respectively, to provide a first radial clearance between said first dove-tail side and said first dove-tail holder and a second radial clearance between said second dove-tail side and said second dove-tail holder, and wherein said first radial clearance is different from said second radial clearance.

4. The rotary apparatus according to claim 3 which additionally comprises means for changing said fluid pressure within said chamber.

5. The rotary apparatus according to claim 4 wherein said pressure changing means comprises a regulator valve.

6. The rotary apparatus according to claim 4 wherein said chamber includes a liquid and said force applied by said processing tool is altered by changing said fluid pressure within said chamber.

7. The rotary apparatus according to claim 6 wherein said chamber comprises a hydraulic cylinder.

8. The rotary apparatus according to claim 4 wherein said chamber includes a gas and said force applied by said processing tool is altered by changing said fluid pressure within said chamber.

9. The rotary apparatus according to claim 8 wherein said chamber comprises a device selected from a pneumatic cylinder and an airbag.

10. The rotary apparatus according to claim 4 wherein said processing tool is a tool selected from a knife, a die cutter, an embossing tool, an ultrasound tool, a bonding tool, and a printing tool.

11. The rotary apparatus according to claim 10 wherein said processing tool comprises a knife having at least one cutting edge.

12. The rotary apparatus according to claim 11 wherein said knife has a square-shaped cross section.

13. A rotary apparatus suitable for processing or working a web or sheet of material, the apparatus comprising:

a) a frame;

b) a first component having an anvil surface, said first component being rotatably mounted on said frame;

c) a second component adapted to hold a processing tool, said second component being rotatably mounted on said frame opposite said first component;

d) drive means for rotating said first component and said second component in opposite directions in a manner suitable for feeding said web or sheet of material between said first and second components;

e) at least one processing tool associated with said tool-holding second component and suitable for working said web or sheet of material positioned between said first and second components; and f) at least one chamber including a fluid, said chamber having a fluid pressure and being in force-transmitting communication with said processing tool or with said anvil surface on said anvil roll such that a change in said fluid pressure within said chamber serves to alter said force applied by said processing tool to said web or sheet of material, wherein said force-transmitting communication is provided by a mounting plate having a first dove-tail side and a second dove-tail side for engaging with a first dove-tail holder and a second dove-tail holder, respectively, to provide a first radial clearance between said first dove-tail side and said first dove-tail holder and a second radial clearance between said second dove-tail side and said second dove-tail holder, and wherein said first radial clearance is different from said second radial clearance.

14. The rotary apparatus according to claim 13 which additionally comprises means for changing said fluid pressure within said chamber.

15. The rotary apparatus according to claim 14 wherein said pressure changing means comprises a regulator valve.

16. The rotary apparatus according to claim 14 wherein said chamber is in force-transmitting communication with said anvil surface of said first component.

17. A rotary cutting apparatus suitable for cutting a web or sheet of material, the apparatus comprising:

a) a frame;

b) an anvil roll having an anvil surface, said anvil roll being rotatably mounted on said frame;

c) a tool roll rotatably mounted on said frame opposite said anvil roll;

d) drive means for rotating said anvil roll and said tool roll in opposite directions in a manner suitable for feeding said web or sheet of material between said anvil roll and said tool roll;

e) at least one knife associated with said tool roll and suitable for cutting said web or sheet of material positioned between said anvil roll and said tool roll; and f) at least one airbag including a gas, said airbag having a pneumatic pressure and being in force-transmitting communication with said knife or with said anvil surface on said anvil roll such that a change in said pneumatic pressure within said airbag serves to alter said force applied by said knife to said web or sheet of material, wherein said force-transmitting communication is provided by a mounting plate having a first dove-tail side and a second dove-tail side for engaging with a first dove-tail holder and a second dove-tail holder, respectively, to provide a first radial clearance between said first dove-tail side and said first dove-tail holder and a second radial clearance between said second dove-tail side and said second dove-tail holder, and wherein said first radial clearance is different from said second radial clearance.

18. The rotary cutting apparatus according to claim 17 which additionally comprises a regulator valve suitable for changing said pneumatic pressure within said airbag.

19. The rotary cutting apparatus according to claim 18 wherein the cutting knife has a square-shaped cross section.

* * * * *

UNITED STATES PATENT AND TRADEMARK OFFICE

CERTIFICATE OF CORRECTION

PATENT NO. : 6,418,828 B1
DATED : July 16, 2002
INVENTOR(S) : Howard J. Kalnitz

It is certified that error appears in the above-identified patent and that said Letters Patent is hereby corrected as shown below:

Column 5,
Line 42, after "thereof" insert -- . --.

Signed and Sealed this

Thirteenth Day of June, 2006

JON W. DUDAS
*Director of the United States Patent and Trademark Office*